US007423936B2

(12) United States Patent
Lizzi

(10) Patent No.: US 7,423,936 B2
(45) Date of Patent: Sep. 9, 2008

(54) ELECTRONIC DEVICE WITH SCHEDULED OCCURRENCE INDICATORS

(75) Inventor: Ronald S. Lizzi, Bethany, CT (US)

(73) Assignee: Timex Group B.V. (NL)

( * ) Notice: Subject to any disclaimer, the term of this patent is extended or adjusted under 35 U.S.C. 154(b) by 303 days.

(21) Appl. No.: 11/221,031

(22) Filed: Sep. 7, 2005

(65) Prior Publication Data

US 2007/0053240 A1 Mar. 8, 2007

(51) Int. Cl.
*G04B 19/20* (2006.01)

(52) U.S. Cl. ..... 368/77; 368/37

(58) Field of Classification Search ..... 368/28, 368/35–38

See application file for complete search history.

(56) References Cited

U.S. PATENT DOCUMENTS 3,901,017 A * 8/1975 Erni et al. ..... 368/37
4,257,113 A * 3/1981 Meister et al. ..... 368/35
4,717,260 A * 1/1988 Tsuji ..... 368/21
5,631,880 A * 5/1997 Houlihan ..... 368/287
6,081,483 A * 6/2000 Capt et al. ..... 368/28
6,766,459 B2 * 7/2004 Shimura et al. ..... 713/320
6,934,221 B2 * 8/2005 Willemin et al. ..... 368/28
7,027,360 B2 * 4/2006 Kitahara et al. ..... 368/28
7,120,091 B1 * 10/2006 Lizzi ..... 368/37

* cited by examiner

*Primary Examiner*—Edwin A. Leon
*Assistant Examiner*—Thanh S Phan
(74) *Attorney, Agent, or Firm*—Carmody & Torrance LLP

(57) ABSTRACT

A display assembly for displaying information in an electronic device comprising a first rotateable ring having a first occurrence indicator thereon; a second rotateable ring having a second occurrence indicator thereon; means for rotating the first rotateable ring so as to selectively position the first occurrence indicator; and rotating the second rotateable ring so as to selectively position the second occurrence indicator; whereby the position of the first occurrence indicator corresponds to a scheduled occurrence of a first occurrence and the position of the second occurrence indicator corresponds to a scheduled occurrence of a second occurrence. In a second embodiment, the display assembly comprises a first rotateable ring having a first highlighted section; a second rotateable ring having a second highlighted section; means for rotating the first rotateable ring so as to selectively position the first highlighted section; and rotating the second rotateable ring so as to selectively position the second highlighted section; whereby an extended highlighted section is provided with a length determined at least in part by the positions of the highlighted sections of the respective first and second rotateable rings.

20 Claims, 7 Drawing Sheets

ELECTRONIC DEVICE WITH SCHEDULED OCCURRENCE INDICATORS

BACKGROUND OF THE INVENTION

The present invention relates to electronic devices such as timepieces in general and wristwatches in particular, and specifically, to an improved construction and methodology for displaying and conveying information regarding the scheduled occurrences of events. Most advantageously although not limited thereto, the present invention is applicable to timepieces that comprise actuation mechanisms, such as stepping motors in particular, for driving rotateable rings, which themselves are typically positioned under a dial.

Timepieces that provide for the indication of scheduled events, such as sunrise and sunset and/or high tide and low tide, just to name two examples, are known. Such indicators are usually in the form of display hands. Also known are the wheel-type displays, whereby as but one example, a moon or sun rotates about a wheel once each day, thus generally indicating daytime or nighttime.

However, it is believed that further advances are both desirable and achievable. For example, it would be desirable to display information regarding the scheduled occurrence of such events, such as sunrise/sunset and/or low/high tide as but two examples, in a user-friendlier manner than provided in the prior art.

Accordingly, it is desirable to provide a timepiece with an improved scheduled occurrence display construction and methodology that overcomes perceived deficiencies in the prior art and further achieves the aforementioned and below mentioned objectives.

SUMMARY AND OBJECTIVES OF THE INVENTION

Accordingly, it is an objective of the present invention to provide an electronic device with an improved scheduled occurrence function.

It is another objective of the present invention to provide an electronic device with an improved scheduled occurrence display.

More specifically, it is an objective to provide an improved construction and methodology to simultaneously and visibly display occurrences (e.g. and/or expected occurrences) of multiple scheduled events.

Still other objects and advantages of the invention will in part be obvious from the specification.

The invention accordingly comprises the features of construction, combination of elements, arrangement of parts and sequence of steps which will be exemplified in the construction, illustration and description hereinafter set forth, and the scope of the invention will be indicated in the claims.

Generally speaking, in accordance with the present invention, an improved electronic device having a display assembly for displaying information is provided.

In a first embodiment, a preferred display assembly comprises a first rotateable ring having a first occurrence indicator thereon; a second rotateable ring having a second occurrence indicator thereon; means for rotating the first rotateable ring so as to selectively position the first occurrence indicator; and rotating the second rotateable ring so as to selectively position the second occurrence indicator; whereby the position of the first occurrence indicator corresponds to a scheduled occurrence of a first occurrence and the position of the second occurrence indicator corresponds to a scheduled occurrence of a second occurrence.

In a second preferred embodiment, the display assembly comprises a first rotateable ring having a first highlighted section; a second rotateable ring having a second highlighted section; means for rotating the first rotateable ring so as to selectively position the first highlighted section; and rotating the second rotateable ring so as to selectively position the second highlighted section; whereby an extended highlighted section is provided with a length determined at least in part by the positions of the highlighted sections of the respective first and second rotateable rings.

BRIEF DESCRIPTION OF THE DRAWINGS

For a fuller understanding of the invention, reference is had to the following description taken in connection with the accompanying figures, in which.

Also, while not all elements are labeled in each figure, all elements with the same reference number indicate similar or identical parts.

DETAILED DESCRIPTION OF THE PREFERRED EMBODIMENTS

Figure 1:
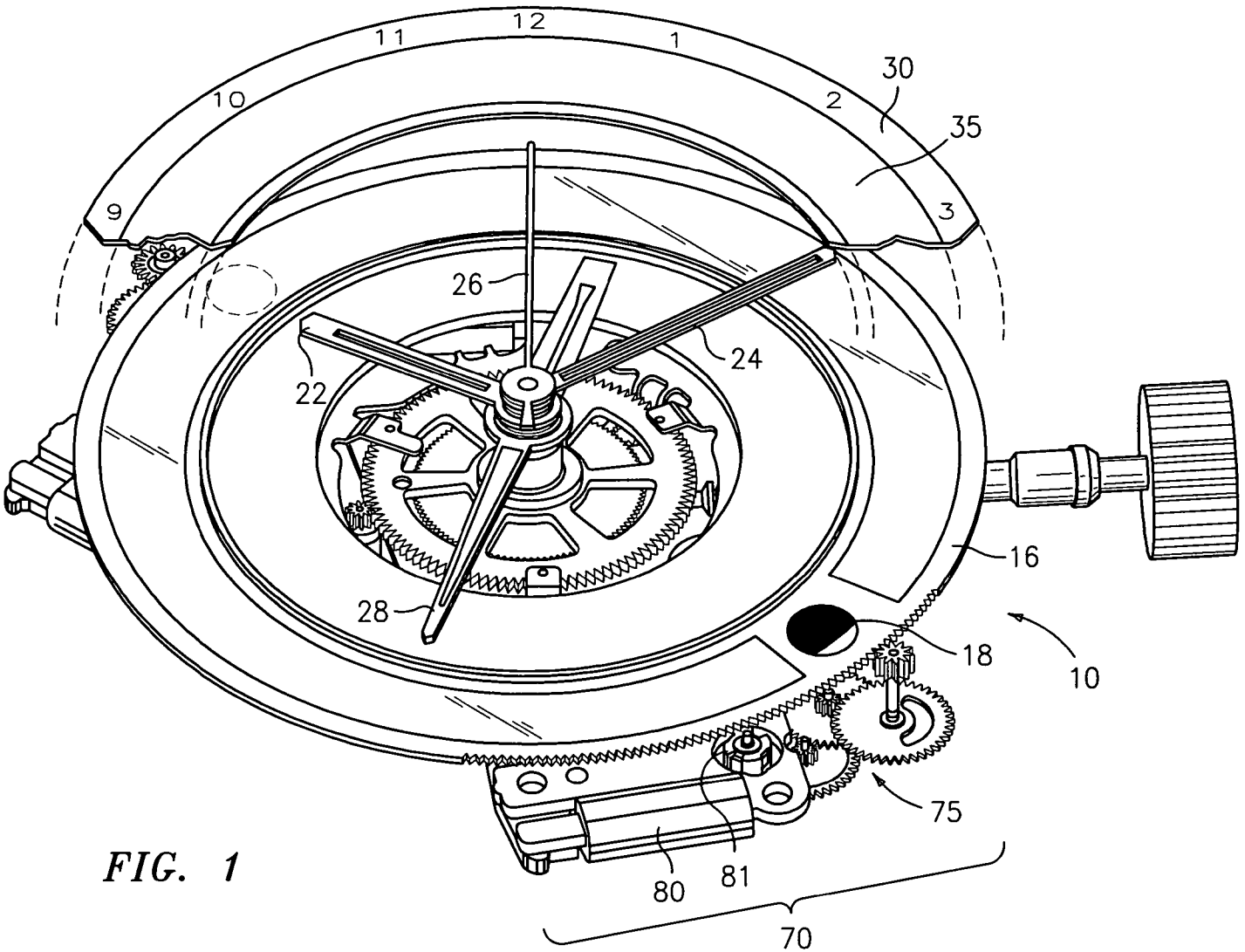
FIG. 1 is a perspective view (in partial exploded view) of a display assembly, constructed in accordance with a first embodiment of the present invention.
Figure 2:
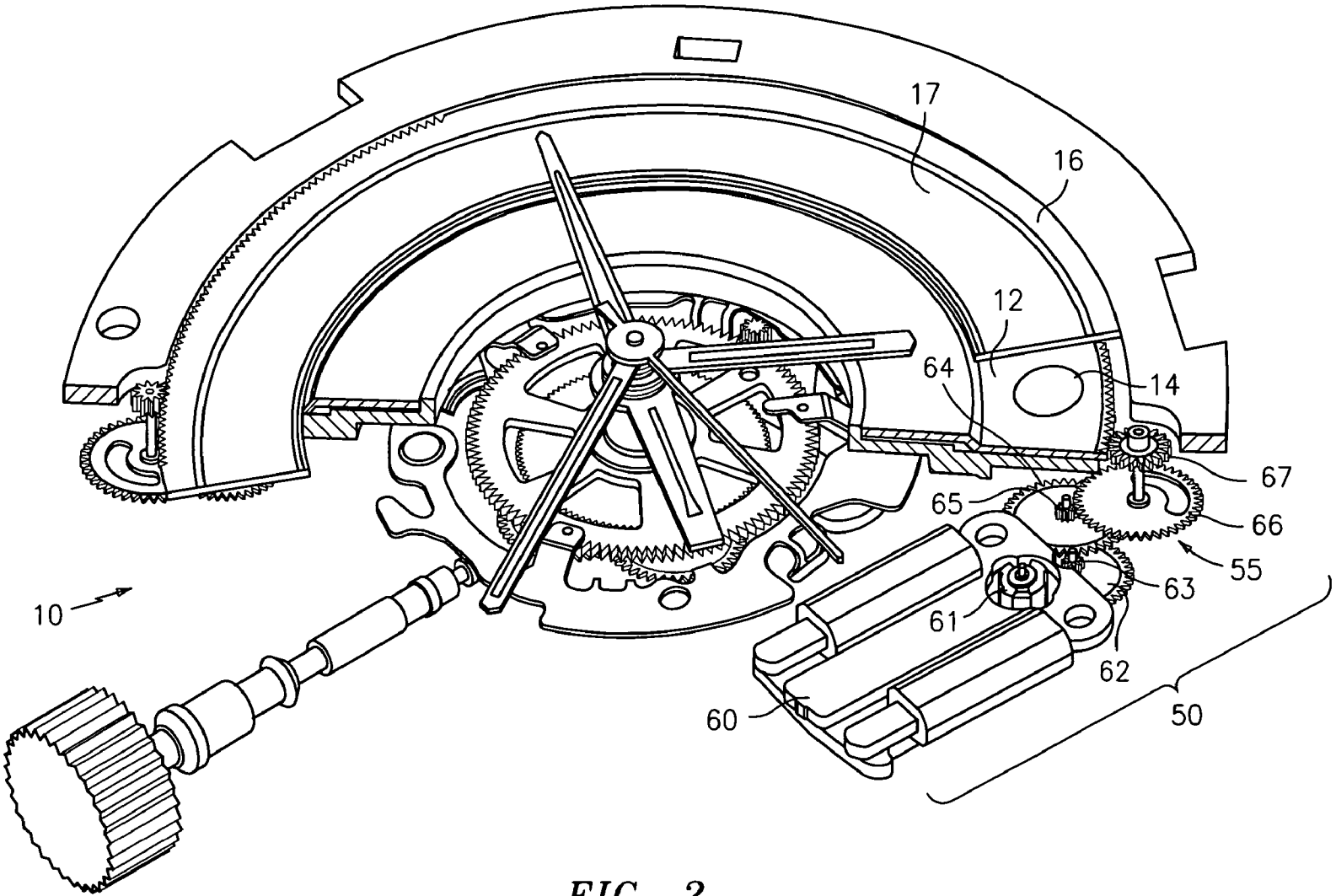
FIG. 2 is a perspective (partial cut-away) view of the display assembly of FIG. 1.
Figure 3:
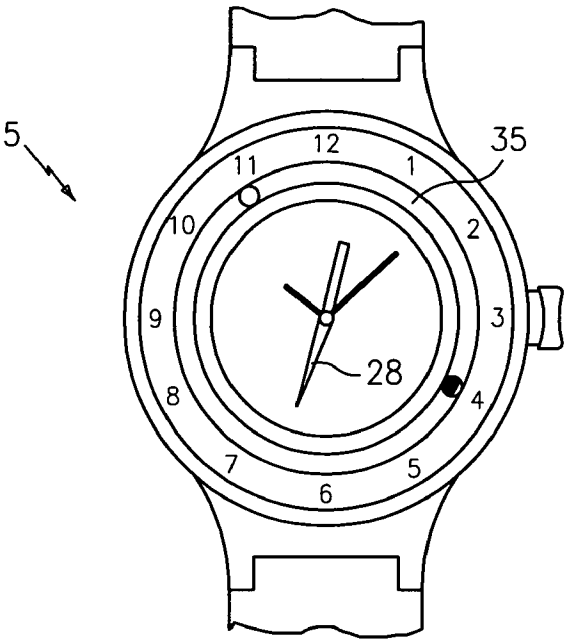
FIG. 3 is a top plan view of the display assembly of FIGS. 1 and 2, showing a preferred construction of the dial as part of a timepiece, the preferred electronic device of the present invention.

Reference is first made generally to FIGS. 1-3, which illustrates a display assembly, generally indicated at 10, constructed in accordance with a first embodiment of the present invention. In the preferred construction, display assembly 10 is part of an electronic device, generally indicated at 5 (in FIG. 3), which is preferably a timepiece in general and a wristwatch in particular. Constructing electronic device 5 with the particulars of display assembly 10, with the knowledge of the details and disclosure as set forth herein, would be within the purview of one skilled in the art. Thus, electronic device 5 may comprise other features and parts not material to the present invention, such as the construction and operation of time-indicating (e.g. hour and minute) hands and timekeeping functionality, all of which is already well known in the art.

In accordance with this first embodiment, display assembly 10 comprises a first rotateable ring 12 having a first occurrence indicator 14 thereon and a second rotateable ring 16 having a second occurrence indicator 18 thereon. In one preferred embodiment, first occurrence indicator 14 is either a low-tide indicator (or a high-tide indicator) and the second occurrence indicator 18 is the other of the low-tide or high-tide indicators. That is, there is no requirement as to which designation is for the particular tide indicator. In an alternative embodiment, first occurrence indicator 14 may be a sunrise designation (again, or a sunset designation) and the second occurrence indicator 18 is the other of the sunrise or sunset designations, again, as there is no requirement of which ring is used for the particular sunrise or sunset. However, for convenience and discussion of this first embodiment of the present invention, first indicator 14 shall be the low-tide indicator.

Display assembly 10 also comprises means for rotating first rotateable ring 12 so as to selectively position first occurrence indicator 14 and for rotating second rotateable ring 16 so as to selectively position second occurrence indicator 18. In this way, the position of first occurrence indicator 14 corresponds to a scheduled occurrence of a first occurrence (e.g. low-tide) and the position of second occurrence indicator 18 corresponds to a scheduled occurrence of a second occurrence (e.g. high-tide).

In the preferred embodiment, the aforementioned means preferably comprises a first assembly, generally indicated at 50, comprising (i) a first gearing assembly generally indicated at 55, comprising one or more wheels being meshingly coupled to first rotateable ring 12 so that the rotation of the one or more wheels causes the rotation of first rotateable ring 12; and (ii) a first stepping motor 60 comprising a rotor 61, wherein the rotor of stepping motor 60 is rotateably coupled to the at least one or more wheels of first gearing assembly 55, wherein the rotation of rotor 61 causes the rotation of first rotateable ring 12; and a second assembly, generally indicated at 70, comprising (i) a second gearing assembly generally indicated at 75, comprising one or more wheels being meshingly coupled to second rotateable ring 16 so that the rotation of the one or more wheels causes the movement of second rotateable ring 16; and (ii) a second stepping motor 80 comprising a rotor 81, wherein the rotor of stepping motor 80 is rotateably coupled to the at least one or more wheels of second gearing assembly 75, wherein the rotation of rotor 81 causes the rotation of second rotateable ring 16.

Although it is believed that the construction of the aforementioned first and second assemblies 50 and 70 are well within the purview of the skilled artisan, the following is set forth for completeness, with particular reference being made to assembly 50. Assembly 70 is constructed in a similar manner.

Assembly 50 comprises stepping motor 60 and gearing assembly 55, comprising one or more wheels operatively coupled to motor 60. Stepping motor 60, which is preferably a bi-directional motor, comprises rotor 61 that is rotateably coupled to at least a first of the wheels of the gearing assembly. That is, the rotor will preferably comprise teeth that meshingly align with the outer teeth of a first wheel 62. In turn, first wheel 62 includes a pinion 63 which itself has teeth that meshingly align with teeth on the outer circumference of a second wheel 64. Second wheel 64 comprises a pinion 65 which itself has teeth that meshingly align with teeth on the outer circumference of a third wheel 66. This third wheel 66 likewise comprises a pinion 67 which itself has teeth that meshingly align with teeth on the outer circumference of ring 12. In this way, the rotation of rotor 61 of motor 60 can cause the rotation of ring 12. It should be understood that the number of wheels and number of teeth on each wheel may be more or less (or different as the case may be) than that set forth herein, and are really one of design choice for the intended function and based upon a number of known criterions, such as power and torque constraints. The selection of a suitable stepping motor and the arrangement and/or positioning of the components are all within the purview of one skilled in the art. Likewise, rings 12 and/or 16 may alternatively be driven by teeth on their inner circumference.

In the preferred embodiment, assemblies 50 and 70 are similarly constructed, so no further details of assembly 70 are needed or necessary.

Electronic device 5 comprises a dial 30 having a viewing window 35. As illustrated in FIGS. 1 and 3, first and second rotateable rings 12, 16 lie beneath dial 30 (it is recognized that in FIG. 1, dial 30 should be in solid lines and the portion of display assembly "under" dial 30 should be in dotted lines, but to ensure a complete understanding of display assembly 10, conventional illustrative techniques have been suspended) and first and second occurrence indicators 14, 18 are visible through viewing window 35. Accordingly, in a preferred embodiment, viewing window 35 extends 360° about the circumference of dial 30 so that first and second occurrence indicators 14, 18 are visible therethrough whereever respectively selectively positioned in window 35.

With second ring 16 overlying at least a portion of first rotateable ring 12, ring 16 includes a window 17 through which occurrence indicator 14 can be seen. In an equally acceptable alternative embodiment, ring 16 may be completely transparent but for the region in which indicator 18 is located. In this way, ring 16 can overlie ring 12, the positioning of assemblies 50 and 70 can be conveniently positioned, and other than for a single orientation (whereby indicator 18 is directly above indicator 14, a position thought to be unlikely), indicators 14 and 18 are simultaneously visible through the viewing window 35 in dial 30, regardless of the positions of the indicators themselves.

As one skilled in the art would know, indicators 14, 18 can be printed, painted, silk-screened or otherwise adhered to or placed on the respective rings.

To be sure, motors 60, 80 are preferably bi-directional stepper motors thus being able to rotate in either direction, and the construction of acceptable stepper motors to functionally operate in this manner are widely available and well within the understanding of those skilled in the art.

To provide the proper and accurate controlling, positioning and rotation of rings 12 and 16, a controller 100 is provided and forms at least a portion of the recited means for rotating the first and second rotateable rings. The reader may also wish to review copending application Ser. No. 10/441,417, the subject matter of which is incorporated by reference as if fully set forth here, for details of a controller and other components, functionality and construction applicable in the present invention.

Figure 4:
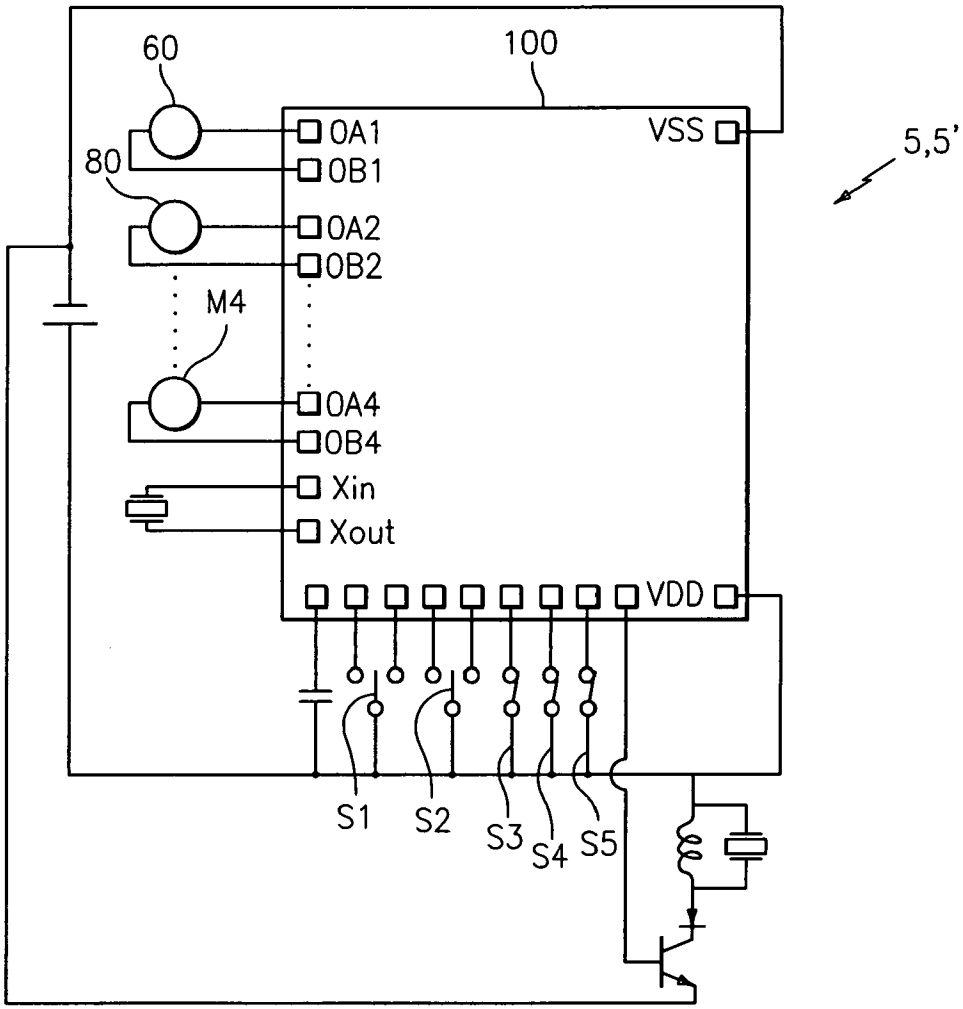
FIG. 4 is a circuit diagram for an electronic device constructed in accordance all the embodiments of the present invention.

General reference may be made to FIG. 4 for a partial block diagram of electronic device 5, which illustrates among other things, interface connections to motors 60, 80, M3 and M4 (the latter two of which generically represent the motors for hour, minute and seconds hands 22, 24, 26 on the one hand and display hand 28 on the other) and switches S1-S5. Switches S1-S5 are intended to generically indicate both side/top mounted pushers, as well as side mounted rotateable crowns, and thus respond to the actuation (i.e. pulling and/or pushing) action thereof. In the case of crowns, the pulling and or pushing actuations may be provided for setting the hour and minute hands, setting and calibrating display hand 28 and/or calibrating and setting rotating rings 12 and 16. A preferred hand and ring calibration methodology and arrangement is disclosed in the aforementioned '417 application and in copending and coowned application Ser. No. 10/737,406 the subject matter which is likewise incorporated by reference as if fully set forth herein. In this way, it is always possible to calibrate (i.e. initialize the position of) hand 28 and/or rings 12 and 16 so that controller 100 knows their respective positions. An input/output control circuit 110 controls the crown actuations and pushbutton switches and provides such signaling information to CPU 101 (see FIG. 5).

Figure 5:
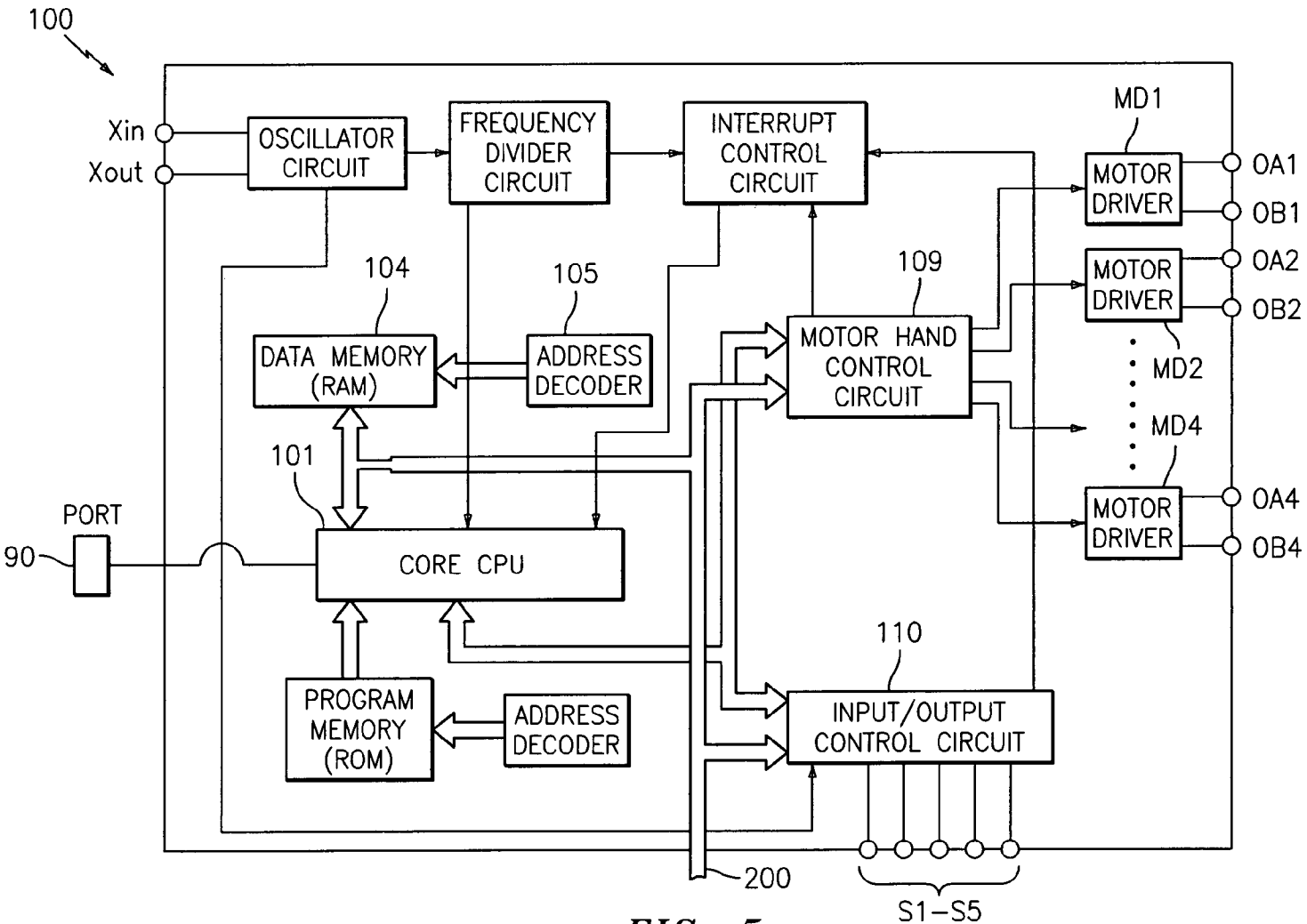
FIG. 5 is a block diagram of a controller for use in the electronic device constructed in accordance with all the embodiments of the present invention.

Reference may also be made to FIG. 5, which illustrates a block diagram of controller 100. Particular reference is made to motor control circuit 109, which receives a commanded "next number of pulses" from CPU core 101 and generates the pulsed and phased signals necessary to move a desired motor (60, 80, M3, M4) a desired amount and in a desired direction. Pulse outputs of motor control circuit 109 are buffered by motor drivers MD1, MD2, MD3, and MD4 and applied to respective motors 60, 80, M3, M4.

Although the preferred embodiment provides that controller 100 is highly integrated wherein all timing and display functionality is controlled in controller 100, alternate embodiments could separate the timekeeping functions from those processing and displaying stored or sensed information, as would be understood by one skilled in the art. A RAM memory block 104, in cooperation with an address decoder 105, provides storage for intermediate calculation values and may also be used to hold current position of the various hands and rings 12, 16 and to store changeable information such as sunrise/sunset charts and tide tables, etc., that may be downloaded into controller 100 through a port, generically indicated by 90, which may be an IR port, a keyboard input, a port for optical transmission, LEDs, RF, or through a computer interface, such as that described in U.S. Pat. No. 5,488,571, incorporated by reference as if fully set forth herein.

The foregoing makes clear that controller 100 will preferably have in its memory (or will be able to receive from an external source (such as via a telephone link, computer link, wirelessly, or the like) for storage in such memory) all the necessary data representative of the stored information such as sunrise/sunset and/or tide information, by way of example. Although not directly contemplated herein, the present invention may be provided with sensor downloadable or receivable information, which likewise may be displayed as set forth herein. With such features and construction, the present invention provides a means and methodology for permitting viewability of next, subsequent or particular upcoming scheduled occurrences. For example, actuation of a particularly configured pusher would cause the rotation of the rings to display a next, subsequent or particular upcoming scheduled occurrence (e.g. of a high or low tide). Successive actuations could display successive upcoming occurrences. Maintaining actuation (i.e. constant pressing) of the pusher could likewise achieve such successive display. Another pusher (or a different sequence of actuations of the same pusher) could be used to return the display to the then current time/date so as to return to displaying the "next" scheduled occurrences. That is, a user could actuate the pusher(s) to view upcoming scheduled occurrences several days out, and then return to the display of the next scheduled occurrences for the actual then current day. For completeness, it is believed that these features could be likewise used for the embodiment to be described below with regard to sunrise and sunset, for example.

As is also known to those skilled in the art, a stepper motor will remain in its last position unless pulsed to move, thus the present construction is very well suited for displaying the information contemplated herein.

Therefore, it can thus be seen that the present invention provides for the receiving of, from an external source, information corresponding to the first occurrence and the second occurrence. In this embodiment, the receiving means, such as port 90 and functionality in core CPU 101, is operatively coupled to the applicable controller functionality for rotating the first and second rotateable rings 12, 16 in the manner set forth above. In this way, rings 12, 16 can be rotated so as to position the first and second occurrence indicators 14, 18 in accordance with the information received from the external source.

Figure 6:
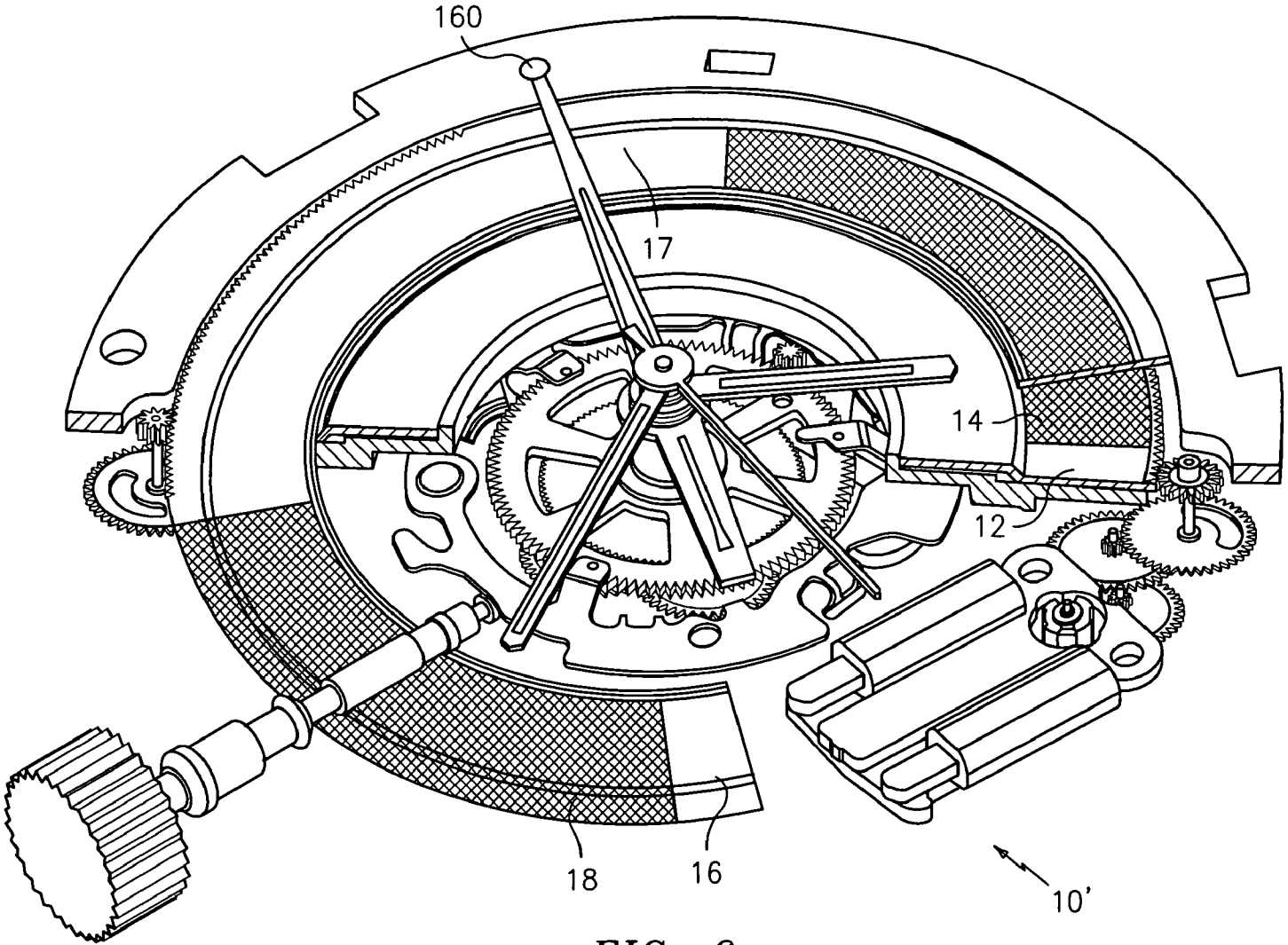
FIG. 6 is a perspective and partial cut-away view of a display assembly, constructed in accordance with a second embodiment of the present invention.
Figure 7:
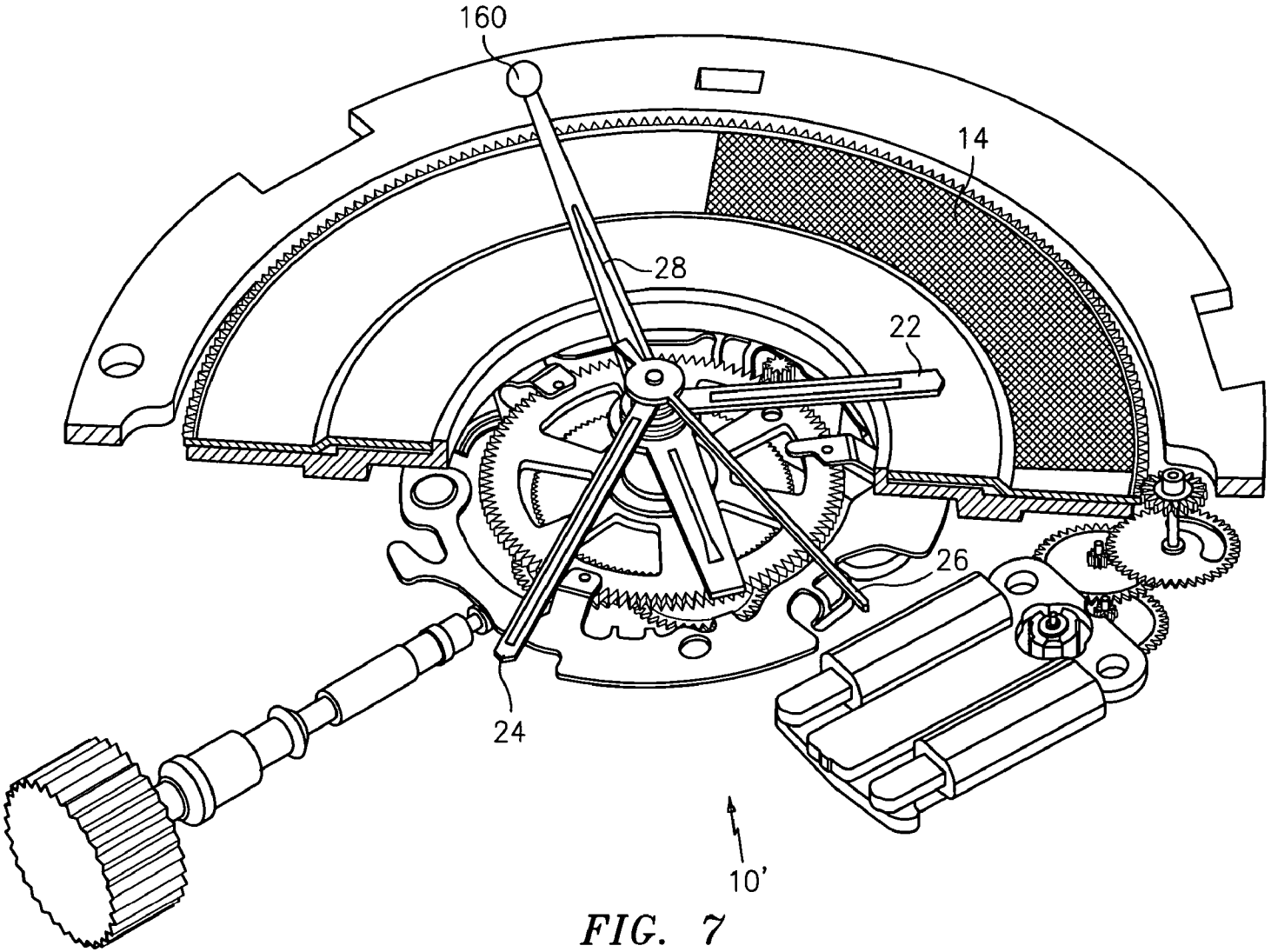
FIG. 7 is a perspective view of components and features of the display assembly of FIG. 6.
Figure 8:
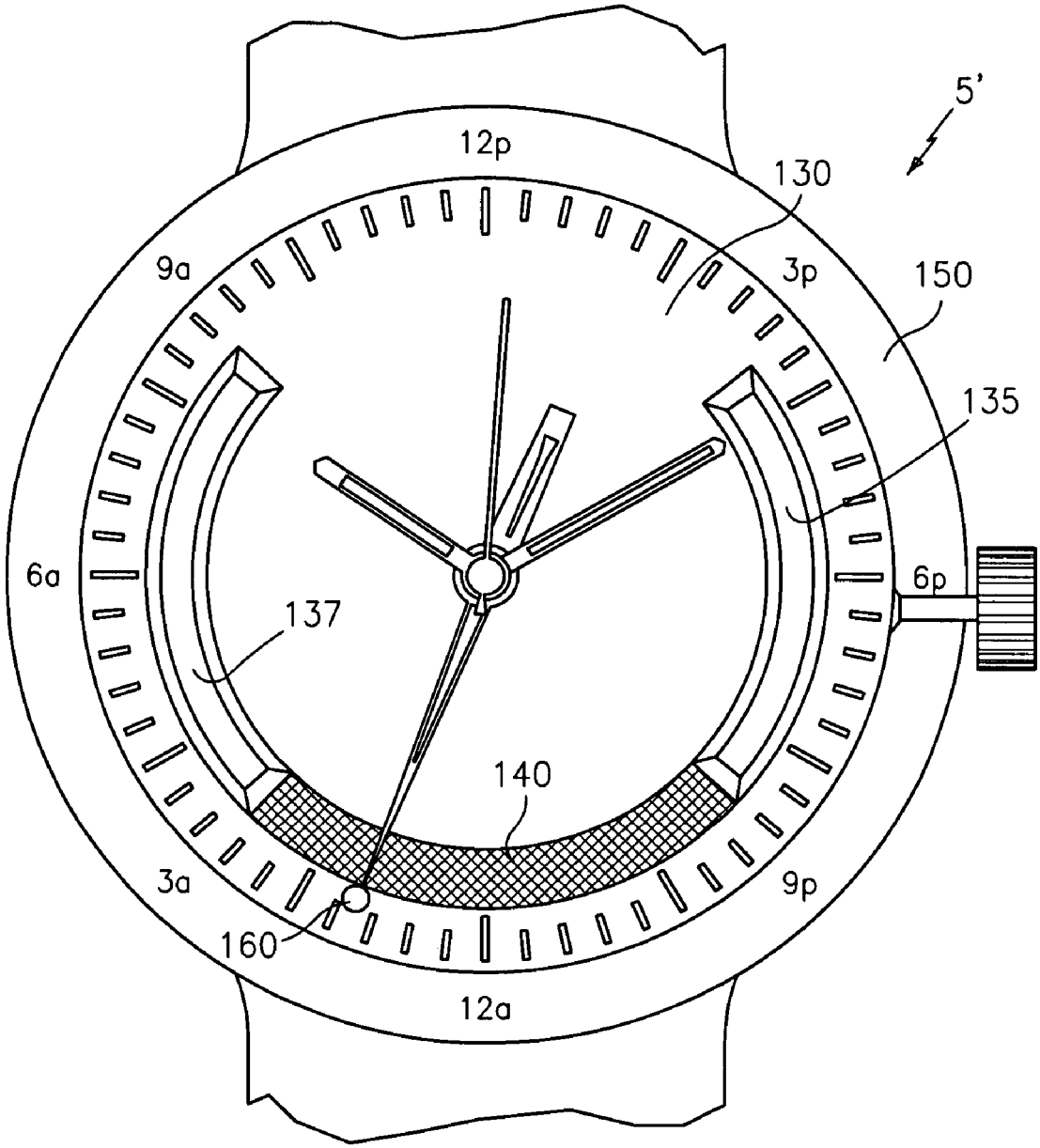
FIG. 8 is a top plan view of the display assembly of FIG. 6, being incorporated into a timepiece, which is the preferred embodiment of the present invention.

Reference is now made to FIGS. 6-8 for a discussion of a second embodiment of the present invention. In this second embodiment, rings 12 and 16 are provided for displaying highlighted sections, that when viewed in conjunction with yet a third highlighted area of the dial, are used to designate periods (or "stretches") of time having a starting time and an ending time. In yet a preferred example of the applicability of the present invention, the starting time is that which corresponds to sunset and the ending time is that which corresponds to sunrise. Particulars of this embodiment will be now be disclosed.

Here too, a display assembly 10' is provided for displaying information, again, in the preferred embodiment being sunrise/sunset information. In this embodiment, display assembly 10' comprises first rotateable ring 12 having a first highlighted section designated by reference numeral 14. Similarly, display assembly 10' comprises a second rotateable ring 16 having a second highlighted section 18. As variously illustrated in FIGS. 6 and 7, the term "highlighted" is intended to mean, and hereby covers any sort of equivalent designation, including "shading" (FIG. 6) or more generic "hashmarks" (e.g. FIG. 7), although in the preferred embodiment, the "highlighting" is more akin to "shading" so as to more descriptively indicate the time-period between sunset and sunrise.

Again, display assembly 10' comprises means for rotating the first rotateable ring so as to selectively position the first highlighted section and for rotating the second rotateable ring so as to selectively position the second highlighted section, whereby an extended highlighted section is provided with a length determined at least in part by the positions of the highlighted sections of the respective first and second rotateable rings. In this second embodiment, the means preferably comprises the same controller, gear assemblies and motor functionality and components as set forth above in the first embodiment of the present invention and therefore, a detailed disclosure thereof is deemed not to be necessary for purposes of brevity.

As illustrated in FIG. 6 (taken in connection with the scale set forth on bezel 150 of FIG. 8), the length of first highlighted section 14 corresponds to roughly a six (6) hour period. Likewise, the length of second highlighted section 18 corresponds to roughly an equivalent six (6) hour period. In their current positions, when placed under a dial 130 of FIG. 8, the position of first highlighted portion 14 would correspond to the period from between about 3 a.m. to 9 a.m. when utilizing the scale illustrated in FIG. 8 and the position of second highlighted section 18 corresponds to the period from between about 3 p.m. to 9 p.m. In the preferred embodiment, first highlighted section 14 provides an indication of an ending of a period of time (e.g. sunrise, 9 a.m.) and the position of second highlighted section 18 provides an indication of a starting of the period of time (e.g. sunset, 3 p.m.). Clearly, the particular times indicated herein are exemplary and not by limitation as it is contemplated that sunset occurs later than 3:00 pm and sunrise occurs earlier than 9:00 a.m.

That is, display assembly 10' comprises dial 130 having two viewing windows 135 and 137, wherein the first and second rotateable rings 12, 16 lie beneath dial 130 and wherein the first and second highlighted sections 14, 18 are visible through viewing window 137 and/or 135. Similarly, with ring 16 overlying at least a portion of first rotateable ring 12, ring 16 includes a window 17 (which extends around the circumference of ring 16) through which highlighted section 14 can be seen. However, in an equally acceptable alternative embodiment, ring 16 may be completely transparent, again, but for highlighted section 18. In this way, ring 16 can overlie ring 12, the positioning of assemblies 50 and 70 can be conveniently positioned and at least respective sections of each highlighted section 14 and 18 can be simultaneously visible through respective viewing windows 137, 135 in dial 130. Likewise, highlighted sections 14 and 18 can be printed, painted, silk-screened or otherwise adhered to or placed on the respective rings.

In the preferred embodiment, dial 130 likewise comprises a shaded area 140 that is intermediate viewing windows 135, 137 and in radial alignment with first and second highlighted sections 14, 18. In this way, first highlighted section 14 and second highlighted section 18 can be positioned in windows 137 and/or 135 such that an extended highlighted section is provided with a length determined at least in part by the positions of the highlighted sections 14, 18 of the respective first and second rotateable rings 12, 16 and the highlighted area 140 of dial 135.

In the foregoing manner, highlighted sections 14, 18 can be positioned in the viewing windows to designate the beginning of a scheduled occurrence (e.g. sunset being designated by the beginning of highlighted section 18) and the end of a scheduled occurrence (e.g. sunrise being designated by the end of highlighted section 14).

In accordance with another aspect of this embodiment, dial 130 (or a bezel, e.g. bezel 150) preferably comprises demarcations of a 24-period, which can exemplary be seen in FIG. 8. That is, a 360° revolution about the timepiece is deemed to be a 24 hour period for purposes of the display assembly 10 (although hands 22, 24, 26 can still use the standard 12 hour designations if applicable). In such a construction, the indicated time period between the first scheduled occurrence (e.g. sunrise) and the second scheduled occurrence (e.g. sunset) can be (i) greater than 12 hours and (ii) simultaneously visible through the one or more viewing windows in the dial without the need for any additional indicators, such as a separate "a.m." or "p.m." indicator (e.g. hand). The foregoing feature of having such a dial or bezel with such designations (i.e. indicating a 24-hour period) is especially advantageous and novel when one considers that in the preferred embodiment, the midnight hour will typically occur sometime intermediate the first and second occurrences.

Additionally, in the manner set forth above with respect to the first embodiment, electronic device 5' may comprise receiving means for receiving, from an external source, information related to the first and second occurrences (e.g. sunrise, sunset information), wherein the receiving means is operatively coupled to the means for rotating the first and second rotateable rings, whereby the means for rotating the first and second rings rotates the first and second rings so as to adjust the length of the highlighted section in accordance with the information received from the external source.

Lastly, in accordance with yet another feature of this second embodiment, hand 28 may be provided with a sun indicator 160. With hand 28 being operatively and rotatably linked with hour hand 22, hand 28 can visibly indicate how many hours of sunlight are left in the day, thus providing an electronic device with the unique ability to simultaneously provide the user with standard time information, scheduled occurrence (e.g. sunrise and sunset) information, and how many hours of sunlight are deemed left in the particular day. In particular, the extended length of the highlighted section formed by highlighted sections 14, 18 and the shaded area of the dial conveys instant information to the user as to the anticipated length of "nighttime" between sunset and sunrise.

Known methodologies provide for the smooth rotation of rings 12 and 16 and well known programming techniques such as those described in the applications incorporated herein by reference set forth acceptable methodologies of ensuring proper, sufficient and accurate stepping of the stepping motor(s). Specifically, these known techniques allow controller 100 to determine whether and when to signal motor control circuit 109 to step the respective stepper motor so that a hand or ring should rotate, and by how much.

The use of the foregoing constructions and arrangements to display tide and sunrise/sunset information should be considered exemplary and not in a limiting sense, as one skilled in the art should be able to envision many other advantageous uses of the present invention, all while remaining within the scope of the claims.

It will thus be seen that the present invention is both patentably different from and a significant improvement over known displays. Specifically, the present invention provides a unique display assembly for simultaneously displaying multiple event occurrences, especially those that may not occur for a period of time of over twelve (12) hours, all of which use rings and stepping motors more widely seen in connection with analog type watches, thereby advancing the display capabilities of such electronic devices.

While the invention has been particularly shown and described with respect to preferred embodiments thereof, it will be understood that changes in form and details may be made therein without departing from the scope and spirit of the invention.

What is claimed is:

1. An electronic device having a display assembly for displaying information, the display assembly comprising:

a first rotateable ring having a first occurrence indicator thereon;

a second rotateable ring having a second occurrence indicator thereon;

a dial having an elongated window, wherein the first and second rotateable rings lie beneath the dial and wherein the first and second occurrence indicators are visible through the elongated viewing window;

means for:

rotating the first rotateable ring so as to selectively position the first occurrence indicator; and rotating the second rotateable ring so as to selectively position the second occurrence indicator;

wherein the position of the first occurrence indicator corresponds to a scheduled occurrence of a first occurrence and the position of the second occurrence indicator corresponds to a scheduled occurrence of a second occurrence; and both the first and second occurrence indicators are selectively positionable at a plurality of positions and wherein both of the first and second indicators are viewable through the elongated window when positioned at each of the plurality of positions.

2. The electronic device as claimed in claim 1, wherein the viewing window extends 360° about the dial so that the first and second occurrence indicators can be visible therethrough whereever respectively selectively positioned.

3. The electronic device as claimed in claim 1, wherein the means comprises:

a first assembly comprising:

a first gearing assembly, comprising one or more wheels, being meshingly coupled to the first rotateable ring so that the rotation of the one or more wheels causes the rotation of the first rotateable ring; and a first stepping motor comprising a rotor, wherein the rotor of the stepping motor is rotateably coupled to the at least one or more wheels of the first gearing assembly, wherein the rotation of the rotor causes the rotation of the first rotateable ring; and a second assembly comprising:

a second gearing assembly, comprising one or more wheels, being meshingly coupled to the second rotateable ring so that the rotation of the one or more wheels causes the movement of the second rotateable ring; and a second stepping motor comprising a rotor, wherein the rotor of the stepping motor is rotateably coupled to the at least one or more wheels of the second gearing assembly, wherein the rotation of the rotor causes the movement of the second rotateable ring.

4. The electronic device as claimed in claim 1, wherein the second rotateable ring overlies at least a portion of the first rotateable ring.

5. The electronic device as claimed in claim 1, including receiving means for receiving, from an external source, information corresponding to the first occurrence and the second occurrence;

wherein the receiving means is operatively coupled to the means for rotating the first and second rotateable rings;

whereby the means for rotating the first and second rings rotates the first and second rings so as to position the first and second occurrence indicators in accordance with the information received from the external source.

6. The electronic device as claimed in claim 1, wherein one of the first and second occurrences is high tide and the other of the first and second occurrences is low tide.

7. The electronic device as claimed in claim 1, wherein one of the first and second occurrences is sunrise and the other of the first and second occurrences is sunset.

8. The electronic device as claimed in claim 1, wherein the dial comprises demarcations of a 24-period;

whereby the indicated time period between the first scheduled occurrence and the second scheduled occurrence is (i) greater than 12 hours and (ii) simultaneously visible through the viewing window in the dial without the need for any additional indicators.

9. The electronic device as claimed in claim 1, wherein the electronic device comprises demarcations of a 24-period;

whereby the indicated time period between the first scheduled occurrence and the second scheduled occurrence is (i) greater than 12 hours and (ii) simultaneously visible through the viewing window in the dial without the need for any additional indicators.

10. A method of displaying information on an electronic device comprising a display assembly that itself comprises a first rotateable ring having a first occurrence indicator thereon, a second rotateable ring having a second occurrence indicator thereon, means for rotating the first rotateable ring so as to selectively position the first occurrence indicator and rotating the second rotateable ring so as to selectively position the second occurrence indicator, a dial having an elongated viewing window, wherein the first and second rotateable rings lie beneath the dial and wherein the first and second occurrence indicators are visible through the viewing window in the dial, wherein the method comprises the steps of:

rotating the first rotateable ring to position the first occurrence indicator about the dial and rotating the second rotateable ring to position the second occurrence indicator about the dial;

visibly indicating the occurrences of the first scheduled occurrence and the second scheduled occurrence by the respective selective positioning of the first and second scheduled occurrence indicators;

wherein the position of the first occurrence indicator corresponds to a scheduled occurrence of a first occurrence and the position of the second occurrence indicator corresponds to a scheduled occurrence of a second occurrence; and wherein the first scheduled occurrence and the second scheduled occurrence are simultaneously visible though the viewing window in the dial; and both the first and second occurrence indicators are selectively positionable at a plurality of positions and wherein both of the first and second indicators are viewable through the elongated window when positioned at each of the plurality of positions.

11. An electronic device having a display assembly for displaying information, the display assembly comprising:

a first rotateable ring having a first highlighted section;

a second rotateable ring having a second highlighted section;

a dial having an elongated window, wherein the first and second rotateable rings lie beneath the dial and wherein the first and second highlighted sections are visible through the elongated viewing window;

means for:

rotating the first rotateable ring so as to selectively position the first highlighted section at a plurality of positions; and rotating the second rotateable ring so as to selectively position the second highlighted section at a plurality of positions;

whereby an extended and visibly continuous highlighted section is provided with a length determined at least in part by the positions of the highlighted sections of the respective first and second rotateable rings; and wherein the extended and visibly continuous highlighted section is viewable through the elongated window when the first and second occurrence indicators are positioned at each of the plurality of positions.

12. The electronic device as claimed in claim 11, wherein the position of the first highlighted section provides an indication of an ending of a period of time and the position of the second highlighted section provides an indication of a starting of the period of time.

13. The electronic device as claimed in claim 11, wherein the dial comprises one or more viewing windows, wherein the first and second rotateable rings lie beneath the dial and wherein at least portions of each of the first and second highlighted sections are simultaneously visible through a respective elongated viewing window.

14. The electronic device as claimed in claim 13, wherein the dial comprises a shaded area that is in alignment with the first and second highlighted sections, whereby the extended highlighted section is provided with a length determined at least in part by the positions of the highlighted sections of the respective first and second rotateable rings and the shaded area of the dial.

15. The electronic device as claimed in claim 14, wherein a beginning of the highlighted section indicates the scheduled occurrence of sunset and an end of the highlighted section indicates the scheduled occurrence of sunrise.

16. The electronic device as claimed in claim 15, wherein the dial comprises demarcations of a 24-period;

whereby the indicated time period between the sunset and sunrise is greater than 12 hours and simultaneously visible though the one or more viewing windows in the dial.

17. The electronic device as claimed in claim 15, wherein the electronic device comprises demarcations of a 24-period;

whereby the indicated time period between the sunset and sunrise is greater than 12 hours and simultaneously visible though the one or more viewing windows in the dial.

18. The electronic device as claimed in claim 14, including receiving means for receiving, from an external source, information related to a first occurrence and a second occurrence;

wherein the receiving means is operatively coupled to the means for rotating the first and second rotateable rings;

whereby the means for rotating the first and second rings rotates the first and second rings so as to adjust the length of the highlighted section in accordance with the information received from the external source.

19. The electronic device as claimed in claim 14, wherein the second rotateable ring overlies the first ring and the dial inhibits the viewing of the first and second highlighted sections that are not positioned in one or more of the viewing windows.

20. The electronic device as claimed in claim 11, wherein the means comprises:

a first assembly comprising:

a first gearing assembly, comprising one or more wheels, being meshingly coupled to the first rotateable ring so that the rotation of the one or more wheels causes the rotation of the first rotateable ring; and a first stepping motor comprising a rotor, wherein the rotor of the stepping motor is rotateably coupled to the at least one or more wheels of the first gearing assembly, wherein the rotation of the rotor causes the rotation of the first rotateable ring; and a second assembly comprising:

a second gearing assembly, comprising one or more wheels, being meshingly coupled to the second rotateable ring so that the rotation of the one or more wheels causes the movement of the second rotateable ring; and a second stepping motor comprising a rotor, wherein the rotor of the stepping motor is rotateably coupled to the at least one or more wheels of the second gearing assembly, wherein the rotation of the rotor causes the movement of the second rotateable ring.

* * * * *